United States Patent [19]

Asano

[11] 3,965,612

[45] June 29, 1976

[54] DRIVING MECHANISM FOR TRAVELING TOY

[75] Inventor: Seiji Asano, Tokyo, Japan

[73] Assignee: Shimsei Kogyo Co., Ltd., Japan

[22] Filed: Nov. 18, 1974

[21] Appl. No.: 524,862

[30] Foreign Application Priority Data

Nov. 21, 1973 Japan ..... 48-134353[U]

[52] U.S. Cl. ..... 46/211; 46/212; 46/262

[51] Int. Cl.[2] ..... A63H 17/40

[58] Field of Search ..... 46/211, 212, 213, 244 R

[56] References Cited

UNITED STATES PATENTS

| | | | |
|---|---|---|---|
| 2,943,418 | 7/1960 | Smith | 46/244 R |
| 3,052,059 | 9/1962 | Einfalt | 46/212 |
| 3,201,898 | 7/1965 | Lahr et al. | 46/244 R |

*Primary Examiner*—Louis G. Mancene
*Assistant Examiner*—Robert F. Cutting
*Attorney, Agent, or Firm*—McGlew and Tuttle

[57] ABSTRACT

A driving mechanism for a travelling toy automatically runs backwardly when its forward movement is hindered by an obstacle. The driving mechanism includes a rotatable sun gear which selectively drives a wheel shaft through either a first or second oppositely facing crown gears secured to the wheel shaft. A pivotal arm carrying an intermediate planetary gear effects drive through the sun gear and planetary gear to a selective crown gear in dependence on the position of the arm. The arm position is controlled by engageable steps and control dogs.

8 Claims, 5 Drawing Figures

DRIVING MECHANISM FOR TRAVELING TOY

BACKGROUND OF THE INVENTION

1. Field of the Invention

The present invention relates to a driving mechanism for a travelling toy, and more particularly to a driving mechanism for a toy which automatically runs backwardly when its forward movement is hindered by an obstacle.

2. Description of the Prior Art

In a known power driven toy capable of running in both forward and backward directions components of the switching mechanism for the reversal of movement are mounted on both sides of the toy. Consequently, the structure of the driving mechanism is complicated and hence is expensive. This is particularly undesirable for children who are consumers of the toy. Also, it is impossible for the known toy to be run by being pushed manually.

SUMMARY OF THE INVENTION

An object of the present invention is to provide a simple driving mechanism for a travelling toy.

Another object of the present invention is to provide a driving mechanism enabling the toy equipped therewith to be run by being pushed manually when the driving mechanism is deenergized.

A further object of the present invention is to provide a running toy equipped with the above-described driving mechanism.

A feature of the present invention is that components of the switching mechanism for reversal of movement are mounted only on one side of the toy to simplify the overall structure of the driving system.

Another feature of the present invention is that the driving shaft of the running toy is, when the driving mechanism is deenergized, disengaged from the driving mechanism to enable the toy to be run manually.

DESCRIPTION OF THE PREFERRED EMBODIMENT

Figure 1:
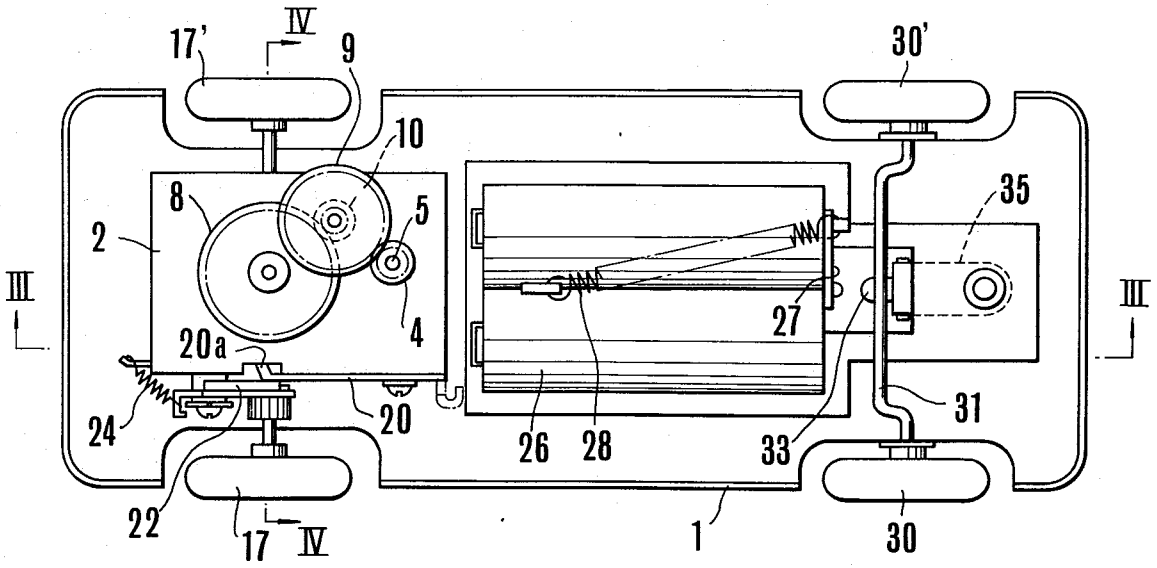
FIG. 1 is a plan view of a running toy from which the body is removed.
Figure 2:
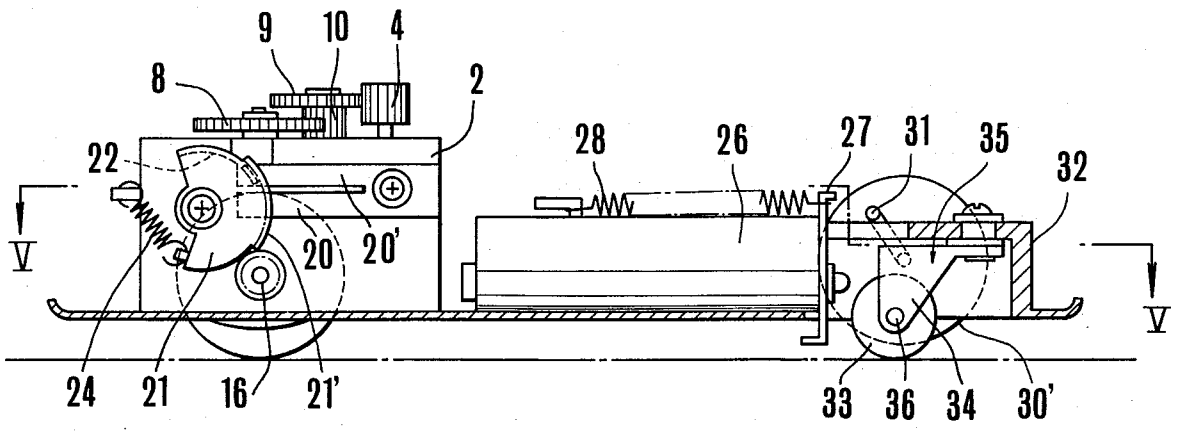
FIG. 2 is a side elevational view partly in cross-section.
Figure 3:
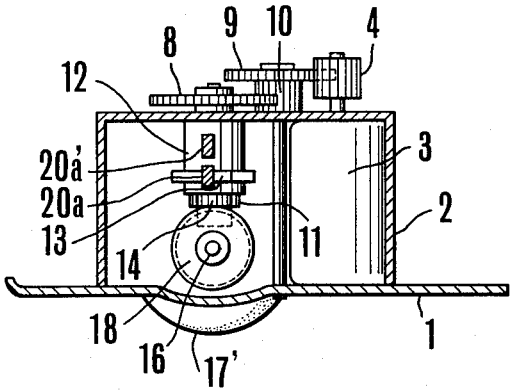
FIG. 3 is a cross-sectional view taken along the line III—III in FIG. 1.
Figure 4:
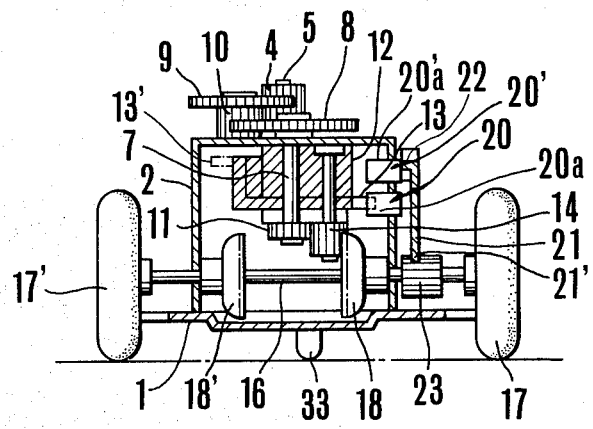
FIG. 4 is a cross-sectional view taken along the line IV—IV in FIG. 1.
Figure 5:
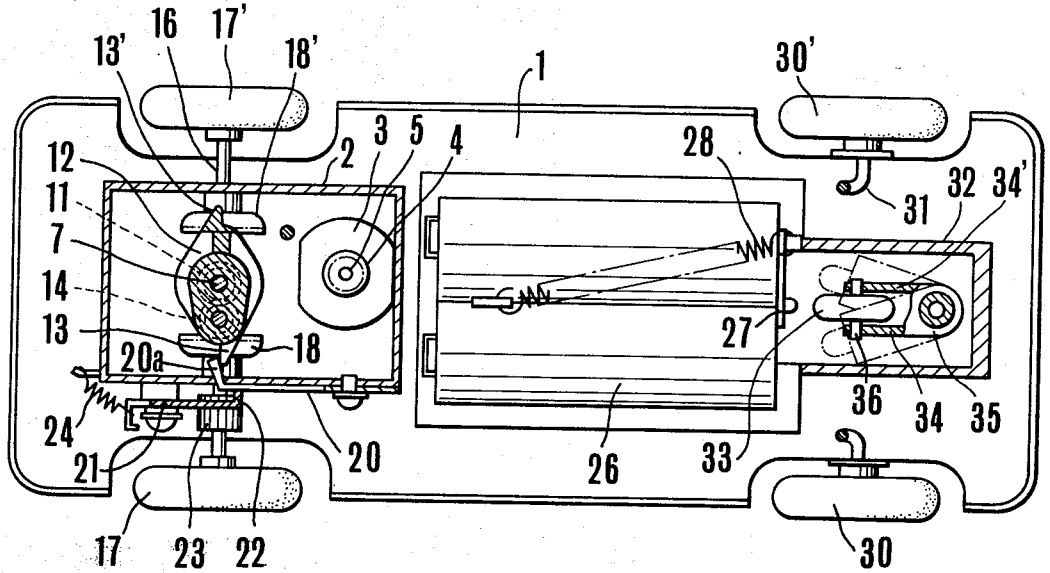
FIG. 5 is a cross-sectional view taken along the line V—V in FIG. 2.

In the accompanying drawings, reference numeral 1 designates a chassis, reference numeral 2 designates a housing, numeral 3 designates an electric motor, and numeral 4 designates a pinion fixed to the rotary shaft 5 of the motor 3. Reference numeral 7 designates a vertical shaft carrying a gear 8 on its upper end. Reference numeral 9 designates an idle gear engaging with the pinion 4 and carrying thereunder a pinion 10 engaging with a gear 8. Reference numeral 11 designates a drive gear fixed to the lower end of the shaft 7 and numeral 12 designates a rotary member or arm rotatably mounted on the shaft 7. Stops or stopping pieces 13, 13′ are mounted on housing 2 in a staggered manner with a 180° phase difference. A pinion 14 is mounted on the rotary member 12 with a shaft fixed thereto and engages with the gear 11 in such a manner that it can make a planetary motion around the gear 11. Reference numeral 16 designates a driving shaft, reference numerals 17 and 17′ designate rear wheel fixed to both ends of the driving shaft 16, and numerals 18 and 18′ designate crown gears fixed to the driving shaft 16 between the rear wheels 17 and 17′ and alternately engaging with the pinion 14. Reference numerals 20 and 20′ designate stoppers or dogs made of a resillient hard synthetic resin fixed to the housing 2 at their one ends and having at the other ends bent portions or clinches **20*a* and 20*a*′ capable of advancing into and retreating from the passes of the rotary stopping pieces 13 and 13′. Reference numeral 21 designates a keeper in the form of a sector gear having a keeper portion 22 which alternately prevents the outward bending or retreat of the stoppers 20 and 20′. Reference numeral 23 designates a pinion fixed to the driving shaft 16 engaging with the teeth 21′ of the sector gear 21 to operate the keeper portion 22 to alternately control the advance position or retreat states of the stoppers 20 and 20′. Reference numeral 24 designates a spring urging the end tooth of the teeth 21′ of the sector gear 21 against the pinion 23**.

Reference numeral 26 designates a housing for a battery (not shown), reference numeral 27 designates a power switch, and reference numeral 28 designates a spring for maintaining the switch 27 in the make or break state. Reference numerals 30 and 30′ designate ornamental front wheels mounted in non-landing state, numeral 31 designates the axle of the front wheels, numeral 32 designates a wheel box fixedly mounted on a frontal part of the chassis 1, and reference numeral 35 generally designates a castor mounted on the underside of the top plate of the wheel box 32 and consisting of a wheel 33 mounted slightly lower than the front wheels 30 and 30′, bearing plates 34 and 34′, and a shaft 36.

In operation, the torque of the motor 3 is transmitted to the rear wheels 17 and 17′ through the rotary shaft 5, the pinion 4, the idle wheel 9, the pinion 10, the gear 8, the shaft 7, sun gear 11, the planetary pinion 14, the crown gear 18, and the driving shaft 16 respectively to drive the toy. If the toy hits an obstacle when in forward motion, the rear wheels 17 and 17′, the driving shaft 16, and the crown gear 18 are interrupted in their rotation by the resistance of the obstacle. Then, since the pinion 14 cannot rotate the crown gear 18 any longer, the pinion 14 begins to rotate around the sun gear 11 as a planetary gear and disengages from the crown gear 18. At the same time, the stopping piece 13 disengages from the clinch **20*a* due to the planetary motion of the pinion 14. The clinch 20*a* temporarily retreats toward wheel 17. The pinion 14 and the rotary member 12 together rotate until the other stopping piece 13′ engages the upper clinch 20*a*′ of the upper stop 20′ which is urged toward 13′ by the keeper portion 22 of the sector gear 21. Thus, the pinion 14 engages with the other crown gear 18′ to transmit the torque to the driving shaft 16 in the reverse direction and hence to the rear wheels to run the toy in a reverse or backward direction. In the initial stage of the backward motion, the sector gear 21 is rotated by the rotation of the pinion 23 fixed to the driving shaft 16 so that the clinch 20*a*′ of the stopper 20′ having been urged toward 13′, is released and the clinch 20*a* of the lower stopper 20 is braced to prepare for the next forward motion. If the toy hits an obstacle during the backward motion, it again reverses its direction of movement in a similar operation to that described above. In this manner the reversal of direction of movement is repeated, at which time the direction of movement is somewhat randam due to the action of the castor 35.**

The feature and advantage of the present invention over the prior art will become more apparent from the following description.

As described above, in the present invention, a pair of stopping pieces 13 and 13' are provided on the rotary member 12 in a staggered manner with a 180° spacing between them and the stops 20 and 20' are mounted side by side on the wall on one side of the housing 2, such that the clinches 20*a* and 20*a'* of the stops 20 and 20' can advance into and retreat from the path of the stopping pieces 13 and 13', respectively. Outside the stoppers 20 and 20' is arranged the sector gear 21 rotatable in engagement with the pinion 23 fixed to the driving. The sector gear 21, having the keeper portion 22, alternately braces the stops 20 and 20' against outward bending.

In contrast, in a prior art mechanism the stops are mounted on both sides of the housing. Consequently, each stop requires its own keeper member. Moreover, a further component for alternately actuating the keeper members is also required.

Thus, the present invention which requires only one keeper member which also acts as an alternator is far less complicated than the prior art.

Furthermore, since the present invention provides the spring 24 for urging the end tooth of the teeth 21' of the sector gear 21 against the pinion 23, the swing angle of the sector gear 21 which swings due to the reversal of the rotation of the pinion 23, can be kept constant. That is, the urge of the keeper portion 22 to the stops 20 and 20' can be effected at predetermined positions to correctly brace or release the stops 20 and 20' at each switching. If the reverse rotation of the driving shaft 16 is started, the teeth portion 21' of the sector gear 21 is immediately and automatically engaged with the pinion 23 to insure switching by the action of the spring 24.

On the other hand, owing to the resiliency of the material of the stops 20 and 20' the pinion 14 retreats due to the repulsive force applied by the clinches 20*a* and 20*a'* of the stoppers 20, and 20' to automatically disengage from the crown gear 18 or 18' when the electric motor 3 is stopped. Thus, the driving shaft 16 is isolated from the driving system and the toy freed to be run manually. Consequently, the toy can be either power or manually driven as desired.

What is claimed is:

1. A driving mechanism for a travelling toy, comprising drive motor means having a rotatable shaft, a sun gear fixed to said rotatable shaft for rotation therewith, a rotary member freely rotatably mounted around said shaft, a pair of stopping pieces provided on said rotary member in staggered locations with a phase difference of substantially 180°, a planetary gear shaft on said rotary member, a planetary gear rotatably mounted on said planetary gear shaft and in alignment with the sun gear so that it can rotate together with the rotary member around said sun gear, a pair of stoppers both mounted on one side wall of said housing in a manner such that they can advance into and retreat from the passes of said stopping pieces, means for controlling the advance and retreat of said stoppers, a wheel shaft rotatably supported at said housing, and a pair of crown gears mounted on said wheel shaft and alternately engageable with said planetary gear.

2. A driving mechanism according to claim 1, in which the stoppers are made of a resilient material.

3. A driving mechanism according to claim 1, in which the means for controlling the states of the stoppers comprises a sector gear having a keeper portion and teeth and pinion fixed to the driving shaft and engaged with the teeth of the sector gear.

4. A driving mechanism according to claim 1, further comprising a spring for urging the end tooth of the teeth of the sector gear against the pinion.

5. A driving mechanism for a travelling toy, comprising a housing, motor means secured in said housing having a rotatable shaft, a first gear secured to said shaft for rotation therewith, an arm pivotal on said shaft, a second gear, means pivotally mounting said second gear on said arm adjacent said first gear and engaged with said first gear, a wheel shaft rotatably mounted in said housing adjacent said first and second gears and having an axis intersecting the axis of said shaft, first and second crown gears secured to said wheel shaft, said arm being pivotal to position said second gear selectively and alternatively into engagement with said first and second crown gears to drive said wheel shaft selectively in a forward and reverse direction. first and second spaced apart stops secured to said arm, first and second resilient dogs arranged on said housing in alignment with the path of movement of respective said first and second stops and located to stop said arm at respective positions at which said second gear is engaged with said first crown gear and said second gear is engaged with said second crown gear respectively, a movable keeper movably mounted on said housing and having a portion in blocking engagement with at least one of said dogs so as to prevent said dogs from retreating by an amount to permit passage of said stop on said arm.

6. A driving mechanism according to claim 5, wherein said keeper includes a portion blocking one of said dogs during a change in movement of said arm to ensure that when the stop of said arm engages said dog, said dog will not be displaced so that said second gear will drive through the associated crown gear without being immediately displaced outwardly therefrom.

7. A device according to claim 6, including means for moving said keeper to drive it out of a blocking position after engagement of the dog behind the stop causes a drive of the toy in the selected direction to move said keeper to a position reinforcing said dog at the position of engagement of said second gear with the other one of said crown gears so as to prevent withdrawal of engagement of the drive between said second gear and said crown gear when engagement in that direction of rotation is initially effected.

8. A driving mechanism according to claim 7, wherein said first and second dogs comprise first and second elongated strip members reinforcing respectives ones of said first and second stops, said keeper comprising a quadrant rotatably mounted behind said strip members and having a portion which is moveable selectively into blocking engagement with selected ones of said first and second strip members.

* * * * *